US007726598B2

(12) United States Patent
Morelli et al.

(10) Patent No.: US 7,726,598 B2
(45) Date of Patent: Jun. 1, 2010

(54) UNWIDING DEVICE FOR REELS OF WEB MATERIAL AND RELATIVE METHOD

(75) Inventors: Alessandro Morelli, Lucca (IT); Mauro Gelli, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 876 days.

(21) Appl. No.: 10/586,590

(22) PCT Filed: Jan. 20, 2005

(86) PCT No.: PCT/IT2005/000028

§ 371 (c)(1),
(2), (4) Date: Aug. 8, 2006

(87) PCT Pub. No.: WO2005/070797

PCT Pub. Date: Aug. 4, 2005

(65) Prior Publication Data

US 2008/0230646 A1 Sep. 25, 2008

(30) Foreign Application Priority Data

Jan. 21, 2004 (IT) ..... FI2004A0016

(51) Int. Cl.
*B65H 19/18* (2006.01)

(52) U.S. Cl. ..... 242/555.5; 242/559.2

(58) Field of Classification Search ..... 242/422, 242/554, 555, 555.3, 555.5, 555.6, 556, 556.1, 242/559.2

See application file for complete search history.

(56) References Cited

U.S. PATENT DOCUMENTS

| | | | | |
|---|---|---|---|---|
| 1,945,136 | A * | 1/1934 | Cline | 242/559.2 |
| 1,967,056 | A * | 7/1934 | Horton | 242/555.6 |
| 2,205,867 | A | 6/1940 | Scott | |
| 2,703,682 | A * | 3/1955 | Jacobs | 242/423.2 |
| 3,172,613 | A | 3/1965 | Simons et al. | |
| 3,655,143 | A * | 4/1972 | Wallis | 242/555.6 |
| 3,863,855 | A * | 2/1975 | Gaubert | 242/554 |
| 5,850,984 | A * | 12/1998 | Kleitz | 242/555.5 |
| 5,855,714 | A | 1/1999 | Bockh | |
| 6,629,664 | B2 * | 10/2003 | Weijenborg | 242/555.5 |
| 6,729,573 | B2 * | 5/2004 | Burri et al. | 242/555.5 |
| 6,764,040 | B2 * | 7/2004 | Kiyota | 242/554 |

* cited by examiner

*Primary Examiner*—William A Rivera
(74) *Attorney, Agent, or Firm*—Breiner & Breiner, L.L.C.

(57) ABSTRACT

The unwinding device comprises: a rotating element (3) with supports (13, 15) for at least two reels (B1; B2; B3); a splicing member (31, 33, 35) to join a first web material (N1) coming from an expiring reel (B1) to the initial free end (T) of a second web material (N2) wound on a new reel (B2). At least one mechanical member (21) is associated with each support (13; 15), to retain the initial free end (T) of the reel disposed on the support, to hold the initial free end until splicing of the two web materials.

32 Claims, 6 Drawing Sheets

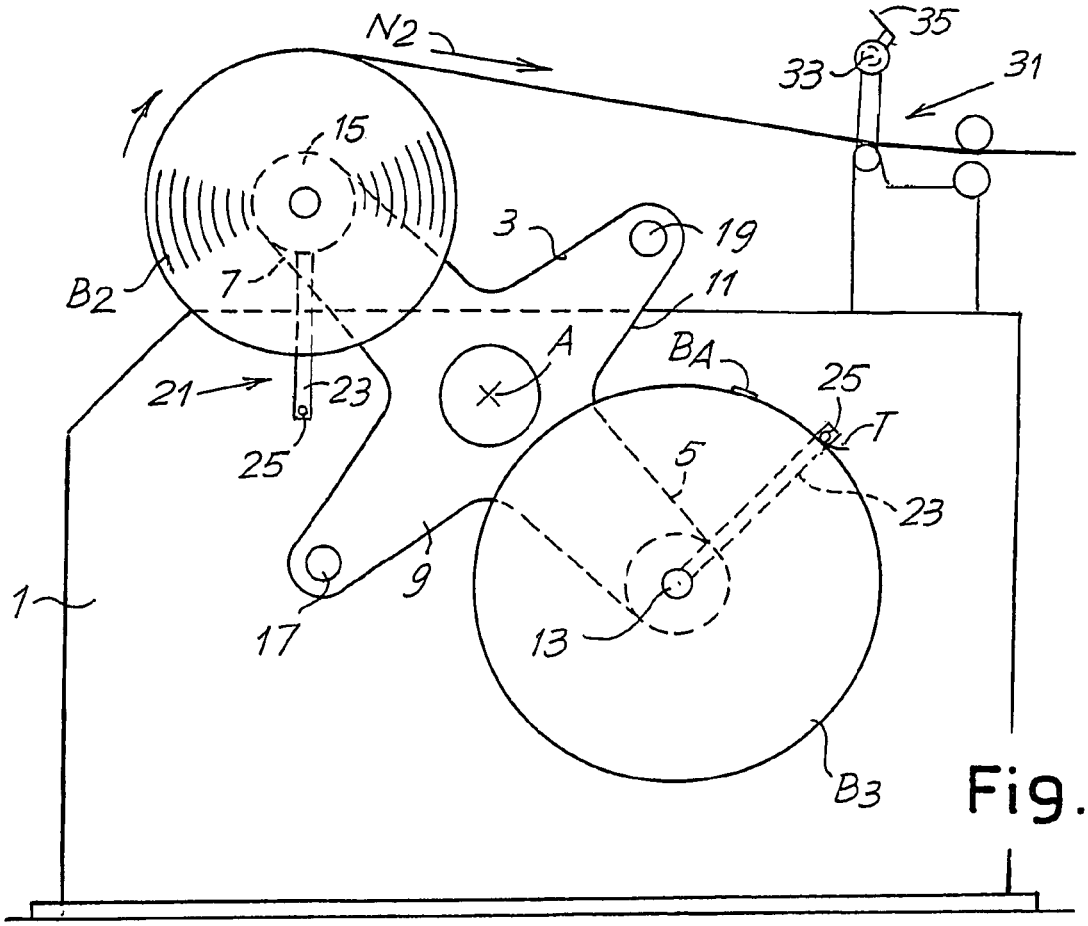
Fig. 4
Fig. 5
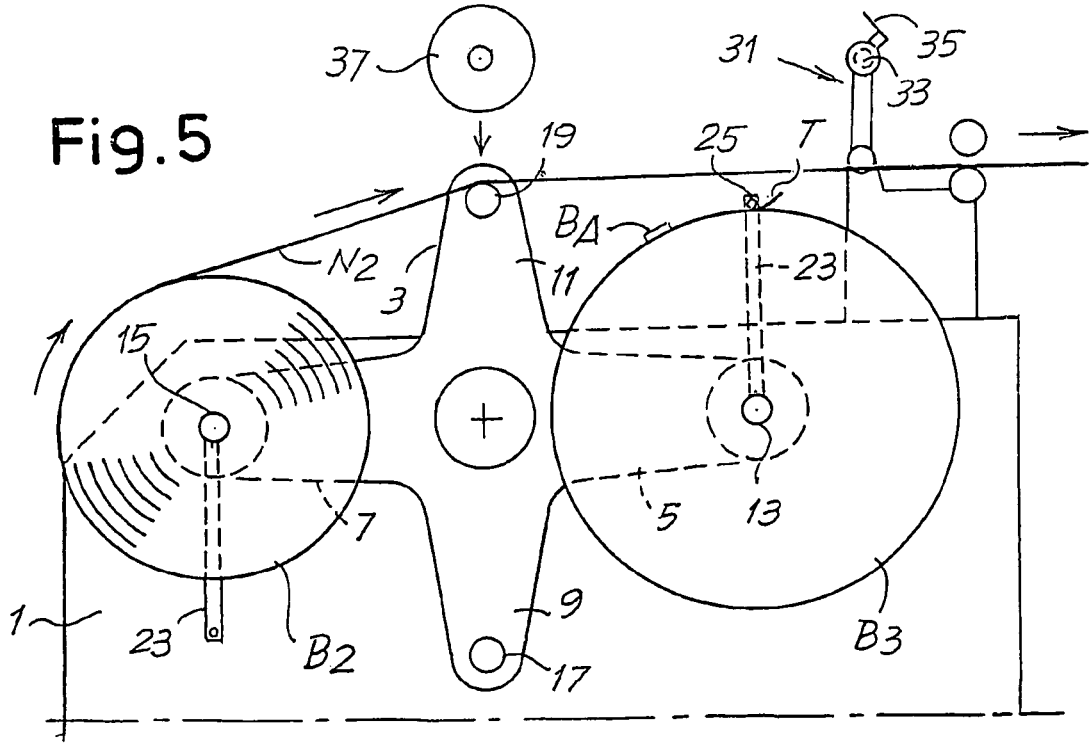

UNWIDING DEVICE FOR REELS OF WEB MATERIAL AND RELATIVE METHOD

TECHNICAL FIELD

The present invention relates to an unwinding device, to unwind reels of web material to be fed to a production line. Typically, the invention in particular relates to an unwinding device for unwinding reels of tissue paper, of the type commonly used to produce rolls of toilet paper, kitchen towels and the like. Specifically, although not exclusively, the invention relates to an unwinding device particularly suitable to unwind reels of a relatively small axial length, to feed machines for the production of paper napkins.

The invention also relates to a method to unwind reels of web material, in particular reels of tissue paper.

STATE OF THE ART

Unwinding devices to unwind reels of web material are known, comprising: a rotating element with supports for at least two reels; and a splicing member to join a first web material coming from an expiring reel to the initial free end of a second web material wound on a new reel. A device of this type is, for example, known from U.S. Pat. No. 1,967,056.

Usually, unwinders of this type are employed to unwind reels of plastic film. The new reel is made to rotate at a peripheral speed equal to the feed speed of the first web material, coming from the expiring reel. This feed speed may have been reduced to carry out splicing of the old and the new web material. The head of the second web material, wound on the second reel, is fixed thereto by an adhesive tape, so that it remains adherent to the reel during the acceleration phase thereof. This phase is also known as "launch" phase.

When splicing of the two web materials is carried out, the adhesive tape used to hold the head end of the new web material is simply detached through the effect of the traction exerted on the web material. The plastic film forming the web material is sufficiently strong to prevent drawbacks.

This operating mode is not compatible with web material with limited tensile strength, such as tissue paper, due to the fact that at the time of splicing of the two web materials, the adhesive tape used to fasten the initial free end of the new reel would cause the material to tear and therefore arrest of the entire production line.

OBJECTS AND SUMMARY OF THE INVENTION

The object of the present invention is to produce an unwinding device of the type described above which is suitable to handle web materials even with limited tensile strength, such as—and typically (although not exclusively)—tissue paper.

Essentially, in the unwinding device according to the invention a mechanical member is associated with each of the reel supports provided on the device, to retain the initial free end of the reel disposed on said support. The head end or initial free end is thereby held mechanically until splicing, without the need to employ adhesive tape.

According to a particularly advantageous embodiment of the invention, the mechanical member is torsionally connectable to the respective support and releasable therefrom, to rotate with the reel or to remain in a deactivated condition while the reel rotates. In this way, the support is carried in rotation to angularly accelerate the reel to the desired peripheral speed, also drawing the mechanical retaining member of the initial free end of the web material in rotation together with the reel. Therefore, the web material on the expiring reel and the initial free end of the new reel are spliced and at a suitable instant (subsequent or simultaneous to splicing) the mechanical member is torsionally released from the support, so that it is in a neutral position in which it does not interfere with unwinding of the new reel.

For example, the mechanical member can comprise an arm, extending radially from the respective support, and a roller carried by the free end of the arm, said roller having an axis parallel to the axis of the reel. The arm can have an adjustable length, to adapt to variable diameters of the reels to be handled. The roller can be connected rigidly to the arm, but preferably is supported idle thereon.

According to a different aspect, the invention relates to a method to continuously feed a web material wound on a reel to a processing machine, comprising the steps of:

feeding a first web material at a feed speed from a first reel;

carrying in rotation a second reel with a second web material;

when the feed speed of the first web material is essentially the same as the peripheral speed of the second reel, joining the first web material to the second web material and interrupting the first web material upstream of the splicing area between the first and the second web material.

Characteristically, according to the invention: the initial free end of the second web material is held adherent to the second reel, until splicing of the first and of the second web material, by means of a mechanical member which rotates with said second reel; and said mechanical member is carried to an idle position after said splicing.

According to an advantageous embodiment of the method of the present invention a strip of double-sided adhesive can be applied to the external surface of the second reel in a rearwards position, in the direction of rotation of the reel, with respect to the position in which said mechanical member holds the initial free end. This strip of double-sided adhesive is used to join together the two web materials.

Further advantageous characteristics and embodiments of the device and of the method according to the invention are indicated in the appended dependent claims.

BRIEF DESCRIPTION OF THE DRAWINGS

The invention shall now be better understood by following the description and accompanying drawing, which shows a non-limiting practical embodiment of the invention. In the drawing, where the same numbers indicate the same or equivalent parts:

FIGS. 1 to 5 show an operating sequence of the device;

DETAILED DESCRIPTION OF THE PREFERRED EMBODIMENT OF THE INVENTION

Figure 1:
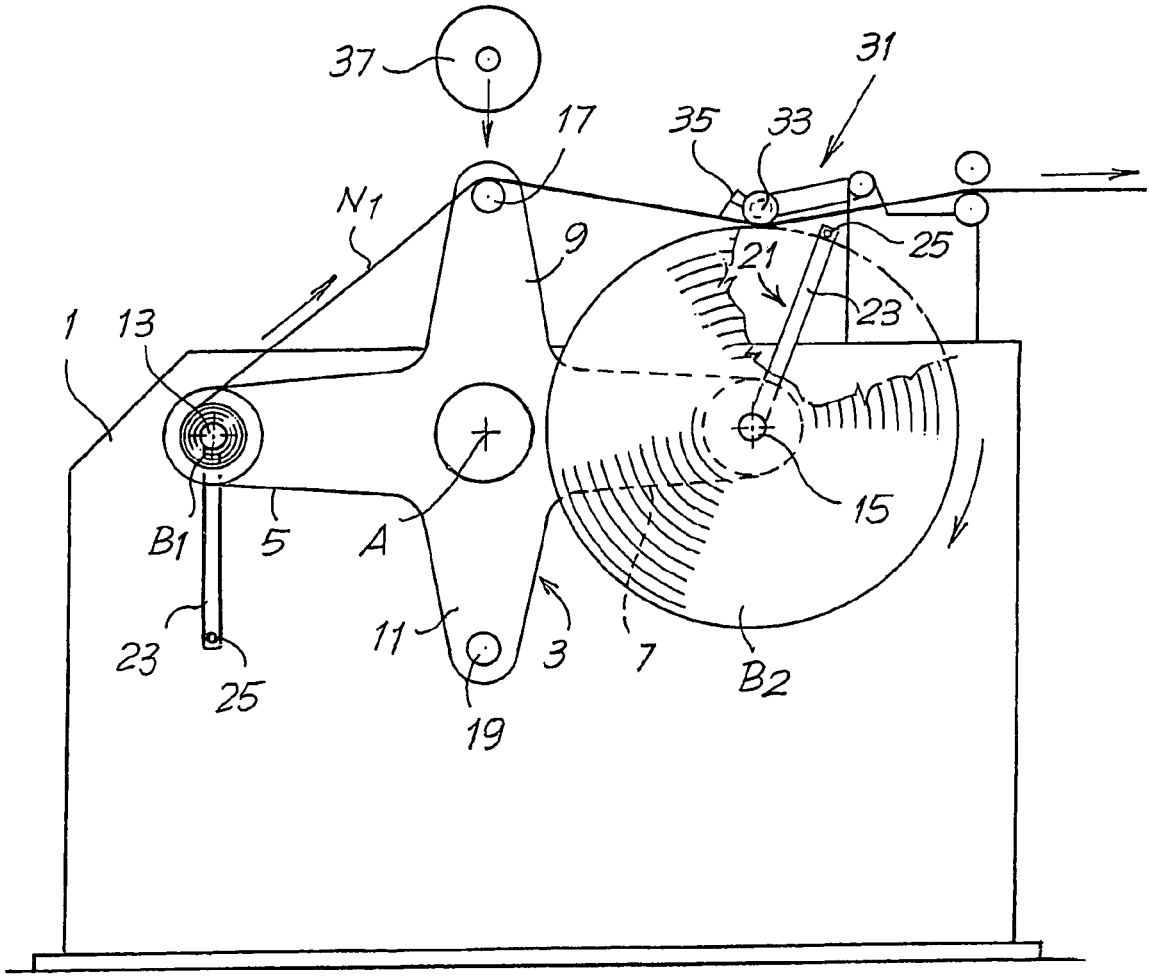

With initial reference to FIGS. 1 to 7, the device of the present invention, shown schematically in various operating positions in the sequence in FIGS. 1 to 5, comprises a bearing structure 1, disposed on which is a rotating element 3, the axis of rotation of which is indicated with A. The rotating element 3 carries two main arms 5, 7 and two secondary arms 9, 11. The main arms 5, 7 carry supports 13, 15 for two reels B1 and B2 of web material. N1 indicates the web material of the reel B1 and N2 the web material of the reel B2. The secondary arms 9, 11 carry two return rollers 17, 19 of the web material.

Each support 13, 15 is motorized and carries means, known and not shown, to torsionally block a respective reel of web material, in order to draw it in rotation. In fact, in this case the device has a central drive system, that is, the reels are carried in rotation by a rotating central support. However, it would also be possible for them to be carried in rotation by a peripheral unwinding system, for example composed of belts in contact with the cylindrical surface of said reels.

Supported on each support 13, 15 and torsionally connectable thereto is a mechanical member, indicated generically with 21 (FIG. 6), comprising an extensible arm 23 extending radially from the support 13 or 15. The extensible arm 23 is torsionally connectable and releasable with respect to the support 13, 15 by means of a pneumatic, hydraulic or other type of system, known and shown schematically at 24.

The distal end of the arm 23 carries an idle roller 25, extending parallel to the axis of the respective support 13 or 15. As can be seen in the schematic representation in FIG. 6, the length of the roller 25 is such that a circular edge of the respective reel B1 or B2 is left free for the purposes described hereunder.

Besides the rotating element 3, the bearing structure 1 supports an oscillating arm 31 which carries a pressure roller 33, with axis parallel to the oscillation axis of the arm 31 and to the rotation axis of the element 3. A blade, indicated with 35, advantageously although not necessarily toothed, is associated with the pressure roller 33. Moreover, a series of ply-bonding wheels 37, cooperating with one or other of the return rollers 17 or 19, is also carried on the structure 1.

Figure 7:
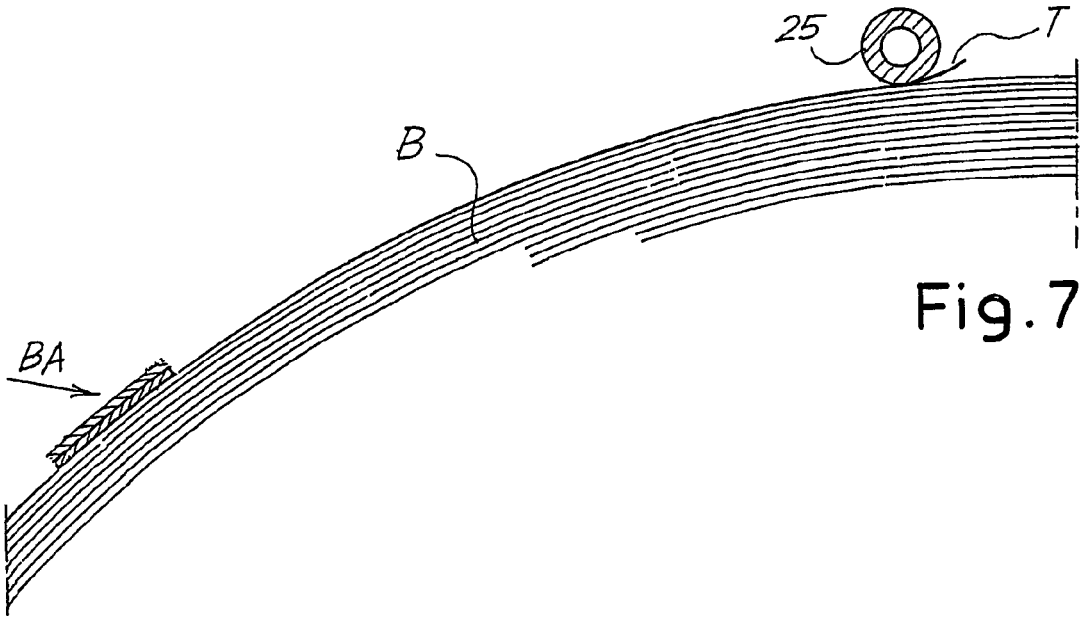
FIG. 7 shows an enlargement of the initial area of the web material.

The device described above operates in the way set forth hereunder with reference to FIGS. 1 to 5 and 7. There are normally two reels on the rotating element 3: a first reel B1 of web material N1 being fed and a second reel B2 of web material N2 standing by. The initial free or head end T of the web material N2 is held adherent to the reel B2 by the corresponding roller 25 of the mechanical retaining member 21 associated with the respective support, which in FIG. 1 is the support 15. Adjacent to the head or initial end T the operator has applied a strip of double-sided adhesive tape BA (FIG. 7).

In FIG. 1 the reel B1 is rotating at a peripheral speed to feed the web material N1 at the feed speed required for correct feed of the line downstream.

When the first reel B1 of web material N1 is about to expire and is to be replaced with the second reel B2, on which a web material N2 is wound, said second reel is carried in rotation with a gradual angular acceleration by means of the respective support 15. Simultaneously, the reel B1 can be slowed down if necessary to carry out exchange of one reel with the other at reduced speed with respect to the normal operating speed. The peripheral speed of the reels B1 and B2 can be detected by respective encoder, in contact with the edge of the reels. For this purpose—as mentioned above—the length of the rollers 25 of the two mechanical members 21 is such that an edge of the reels is left free.

During the angular acceleration phase of the reel B2, the mechanical retaining member 21 remains torsionally connected to the support 15 so that it rotates with the reel. The rotating element 3 is in the position in which the support 15 which carries the new reel B2 of web material N2 is located downstream, with respect to the direction of feed of the material N1, and therefore approximately under the pressure roller 33 and the cutting blade 35.

When the peripheral speed of the reel B2 reaches the feed speed of the web material N1 from the reel B1, automatic splicing of the two web materials N1, N2 can take place. In FIG. 1 this splicing operation is already in the execution phase: in fact, the pressure roller 33 is in contact with the reel B2 and presses thereagainst the web material N1 coming from the expiring reel B1. The pressure roller 33 presses on the reel in the area between the roller 25 and the strip of double-sided adhesive tape BA and continues to press until the strip of double-sided adhesive tape BA has passed thereunder, to obtain splicing of the two webs.

In actual fact, especially when the diameter of the roller 25 is very small, the pressure roller 33 can also come into contact with the reel and press thereon in a position upstream of the roller 25, which can be <<by-passed>> by the pressure roller 33 during rotation of the reel.

When the strip of double-sided adhesive tape BA passes under the pressure roller 33, the pressure exerted by the roller 33 causes reciprocal adhesion of the two web materials N1 and N2. The cutting blade 35 subsequently cuts the tail of the web material N1, allowing feed of the web material N2 to continue, while the reel B1 is removed.

Before splicing of the two plies by means of the strip of double-sided adhesive tape BA, the roller 25 remains fixed on the reel B2, as the entire mechanical member 21 rotates integral therewith. The pressure roller 33, which presses on the external surface of the reel B2, can easily by-pass the roller 25 thanks to the small diameter of the latter.

Figure 2:
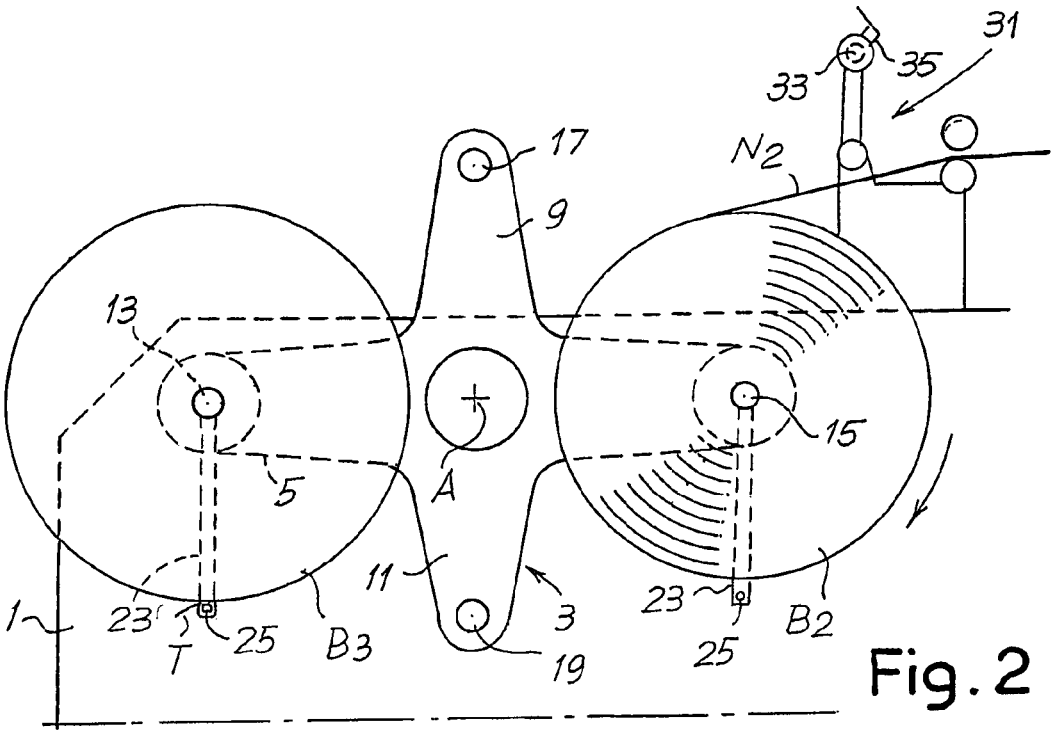
Figure 3:
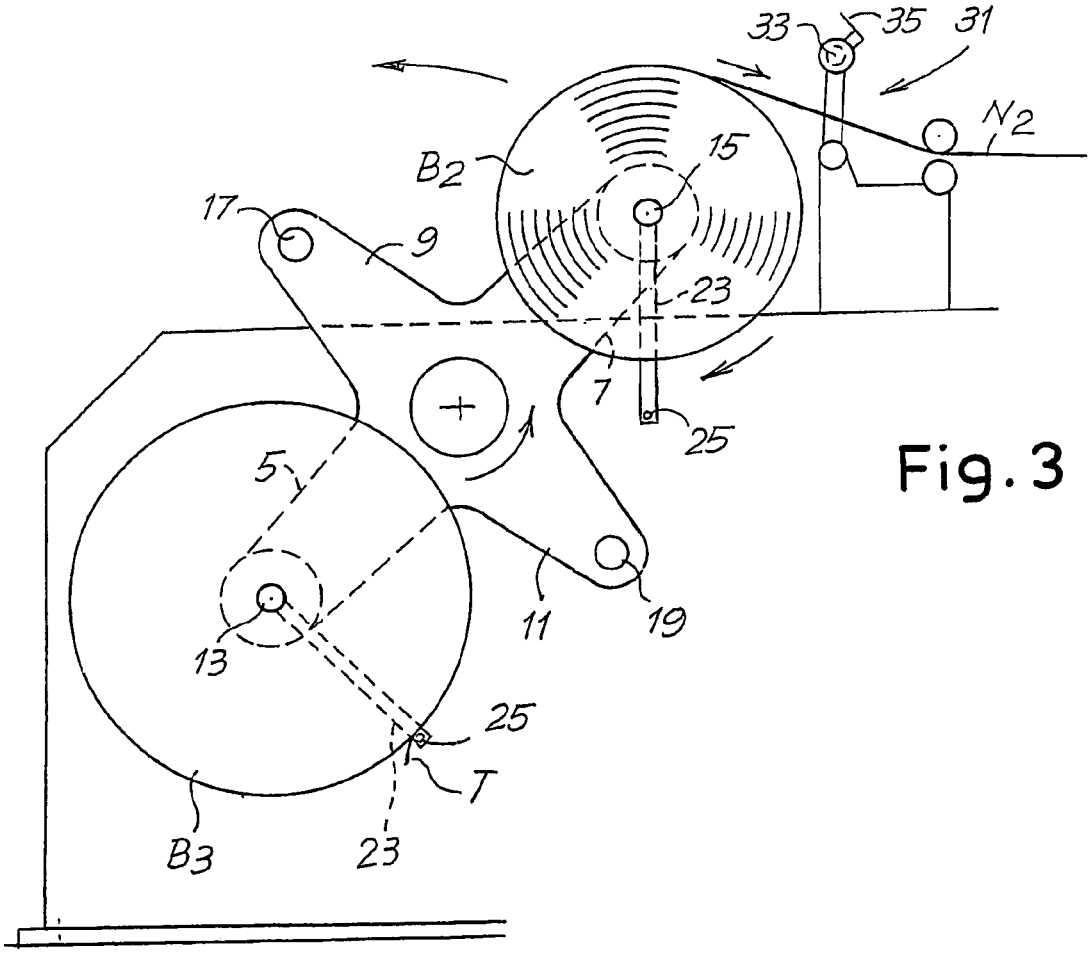
Figure 6:
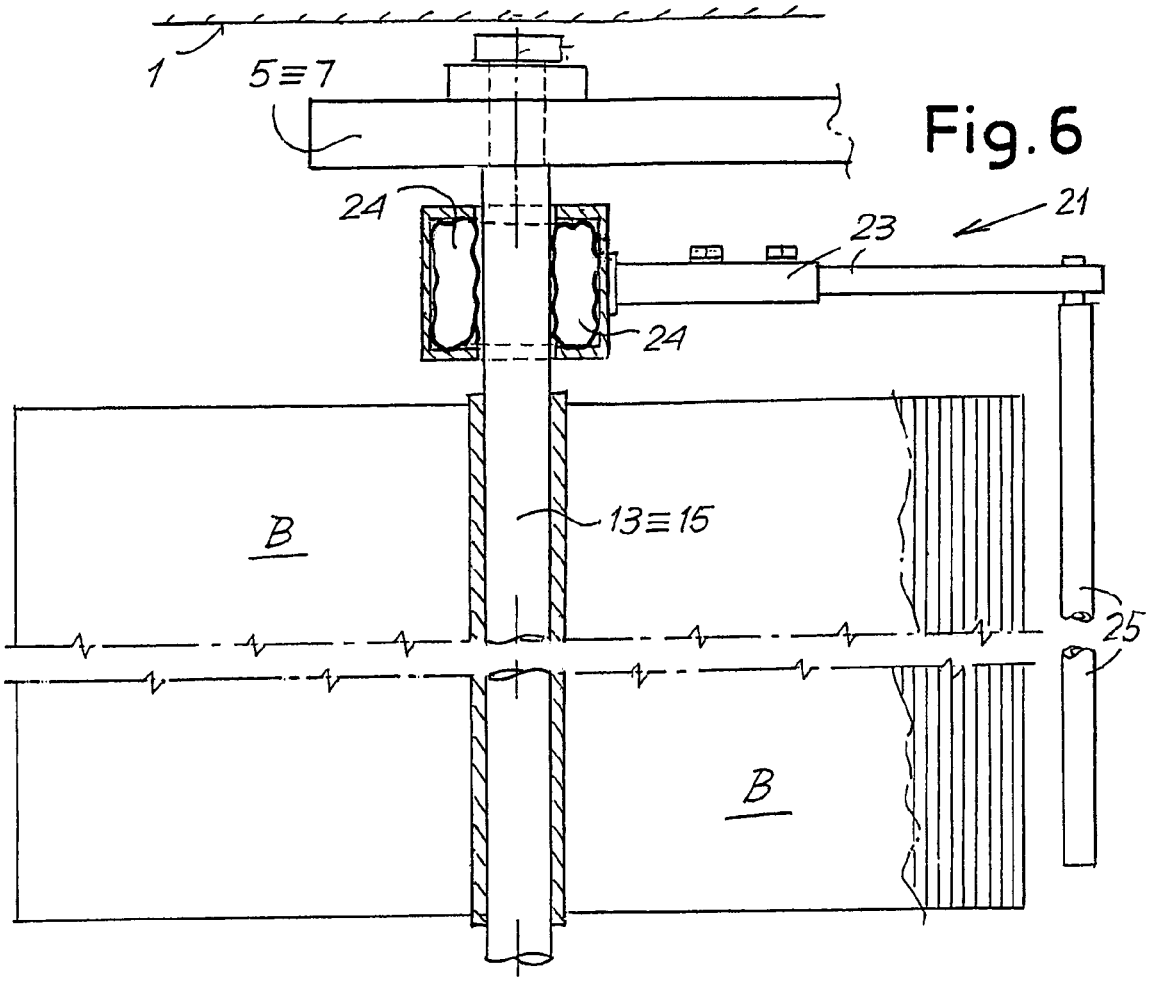
FIG. 6 shows a section of the arm of the mechanical retaining member of the initial free end of the new reel.

Once splicing has taken place, the mechanical member 21 associated with the support 15 of the reel B2 is torsionally released from the support 15 and is positioned vertically, hanging downwards from said support, as shown in FIG. 2. It no longer interferes with unwinding of the reel B2.

The reel B2 is replaced with a new reel B3 (FIG. 2) and the rotating element 3 can invert the positions of the arms 5, 7 with a rotation through 180°, as shown in the passage from FIG. 2 to FIG. 5. The reel B2 ceases to feed the web material N2 in the position in FIG. 5, while the reel B3 remains standing by, with the free or head end T of the web material N3 wound thereon held by the mechanical member 21 associated with the support 13. The cycle then restarts as described, to replace the reel B2 with the reel B3.

The ply-bonding wheels 37 can be utilized in particular when the web materials N1, N2, N3 are composed of two or more plies. In this case the reels are activated to join the plies of expiring web material together stably, before splicing to the new web material. In fact, they act on one or other of the return rollers 17, 19, immediately upstream of the splicing area with the web material of the new reel standing by. The plies forming the new web material are prepared by the operator so that they are joined together in the initial or head portion of the web material. In this way the strip of double-sided adhesive tape BA joins together the outermost ply of the new reel with the innermost ply of the expiring reel. Ply-bonding of the material coming from the expiring reel and suitable preparation of the head portion of the material coming from the second reel ensure that the other plies are also joined.

It would also be possible to arrange the ply-bonding system in another position along the path of the web materials, or to use another splicing system, for example a glue that seeps through. In any case, notwithstanding the splicing system, the portion of web material containing the joining area of the materials coming from the two reels is advantageously discarded. The part to be discarded can be easily identified, for example with marking by means of an inkjet, which may even be a UV ink, visible only in ultraviolet light.

Figure 8:
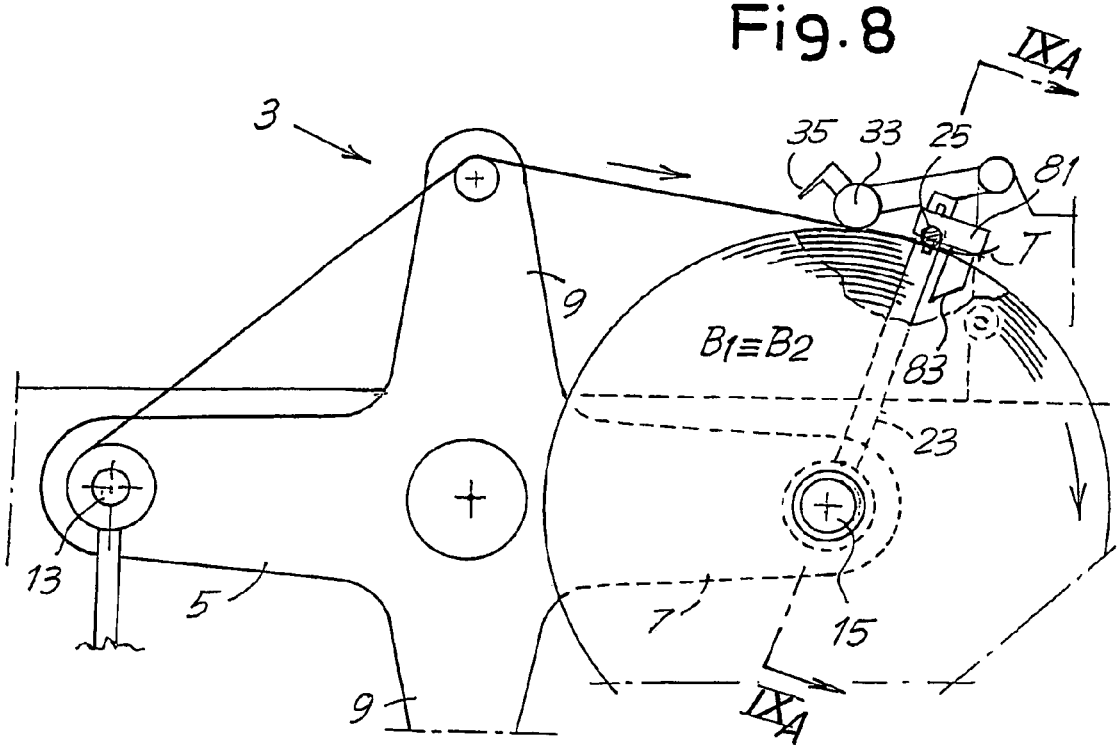
FIG. 8 shows a side view of a detail of a device according to the invention in a different embodiment.
Figure 9:
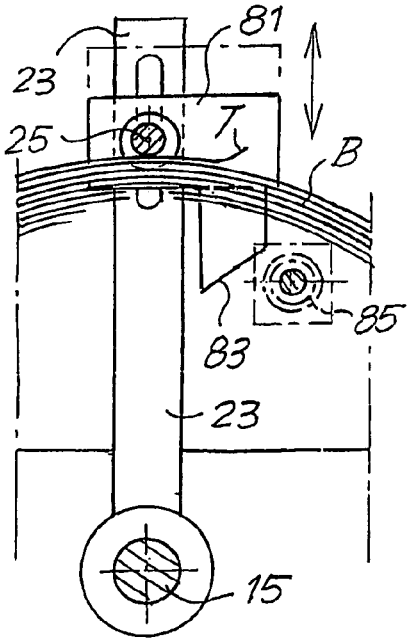
FIG. 9 shows a view according to IX-IX in FIG. 9A.
Figure 9A:
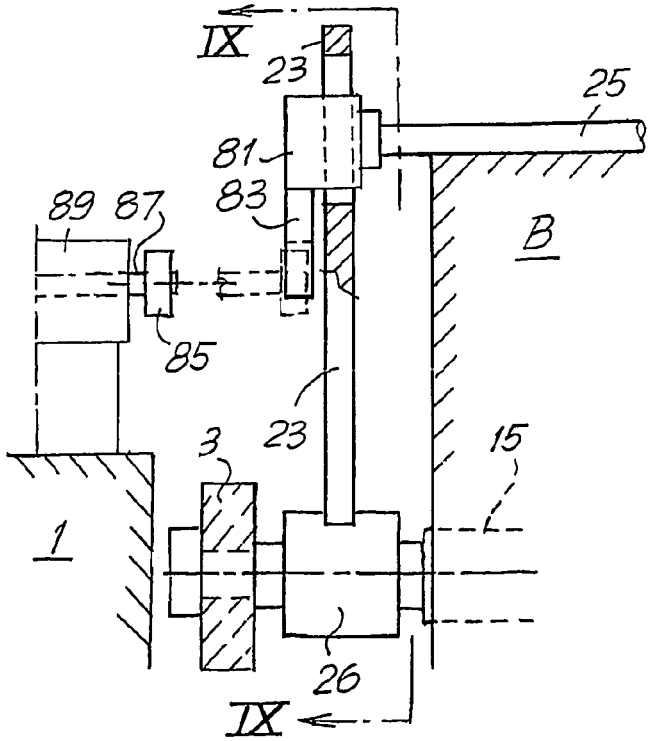
FIG. 9A shows a section according to $IX_A$-$IX_A$ in FIG. 8.

FIGS. 8, 9 and 9A show a variant of embodiment of the device according to the invention. The same numbers indicate the same or equivalent parts to those in the previous embodiment. The figures show only one of the mechanical retaining members of the initial end of the web material, but it is understood that an equivalent member is associated with each reel support of the device.

In this configuration, the mechanical retaining member of the initial free or head end T of each reel B1, B2 again has an arm 23 which, however, unlike the previous example, is not torsionally connected directly to the support 13 or 15 of the respective reel, but is supported idle thereon. The arm 23 again carries a roller 25 or other retaining element of the head end T. The roller 25 is integral with a slide 81 sliding at the end of the arm 23, to advance towards and withdraw from the cylindrical surface of the reel B1 or B2. In the layout in FIGS. 8, 9 and 9A, the slide 81 is in the position closest to the axis of the respective reel compatibly with the presence of the roller 25, which presses on the cylindrical surface of said reel. In this layout the roller 25 on one hand holds the end T and on the other torsionally connects the arm 23 and in general the entire mechanical member 23, 25 to the reel B1, B2 and therefore, indirectly, to the reel support.

This position with the roller 25 closest to the reel B1 or B2 is guaranteed by a blocking system of a suitable type, for example even simply by friction between the slide 81 and the arm 23.

When the device carries out splicing of the two web materials, having taking the full reel in the stand-by position at a peripheral speed essentially the same as the feed speed of the web material fed from the working reel, according to the description above with reference to the previous figures, the free end T is released from the reel. For this purpose a mechanism is provided to cause the slide 81 carrying the roller 25 to withdraw in a radial direction, along the arm 23. In the example shown, this mechanism has a cam profile or one with an inclined plane 83, integral with the slide 81. This cam profile 83 can cooperate with a wheel 85 carried by a rod 87 controlled by an actuator 89 integral with the side panel 1 of the device. During the angular acceleration phase of the reel B1 or B2, before splicing of the two plies the wheel 85 is in the withdrawn position shown with the solid line in FIG. 9A. When the free head end T is to be released, the wheel 85 is taken to the active position, that is, the position shown with the dashed line in FIG. 9A, in which it interferes with the trajectory of the cam profile 83. When—through the effect of rotation of the arm 23 drawn by the reel B1 or B2—the arm 23 passes in front of the wheel 85, this cooperates with the cam profile 83 causing centrifugal radial movement of the slide 81 and therefore release of the free end T. Simultaneously, the same movement causes torsional release between the arm 23 and the roller 25 on the one hand and the reel B1 or B2 on the other. Thanks to the position of the wheel with respect to the axis of rotation of the reel B1 or B2 (see FIG. 8), the arm 23 with the roller 25 and the slide 81 drops to the lower position moving to a withdrawn and idle position so that it does not interfere with subsequent feed of web material from the reel, in the same way as described with reference to the sequence in FIGS. 1 to 5.

FIGS. 10-13 show a further variant of embodiment of the invention. The same numbers indicated the same or equivalent parts of the device. In this embodiment, the mechanical retaining member of the free end T of each reel comprises a pair of disks 23A, 23B mounted on the respective support 13 or 15. The first end of an elastic member, indicated with 25 as it performs the same function as the roller 25 of the previous embodiments, is fixed to the disk 23A. The opposite end of the elastic member 25 is connected reversibly to the outside of the other disk 25B. In the schematic example shown, this reversible connection is obtained by a hook 91 hinged in 91A to the disk 23B, according to an axis parallel to the axis of the reel and engaging in an eye fastened to the end of the elastic member 25. The disks 23A, 23B can be replaced by arms analogous to the arm 23 of the embodiments described with reference to the previous figures.

The hook 91 is provided with an extension 91B destined to cooperate with a wheel indicated again with 85 and having the same functions as the wheel 85 of the previous embodiment.

The elastic member 25 fixed with the two ends to the disks 23A and 23B holds the end T during the angular acceleration phase of the reel B1 or B2 until splicing to the web material of the other reel.

Figure 10:
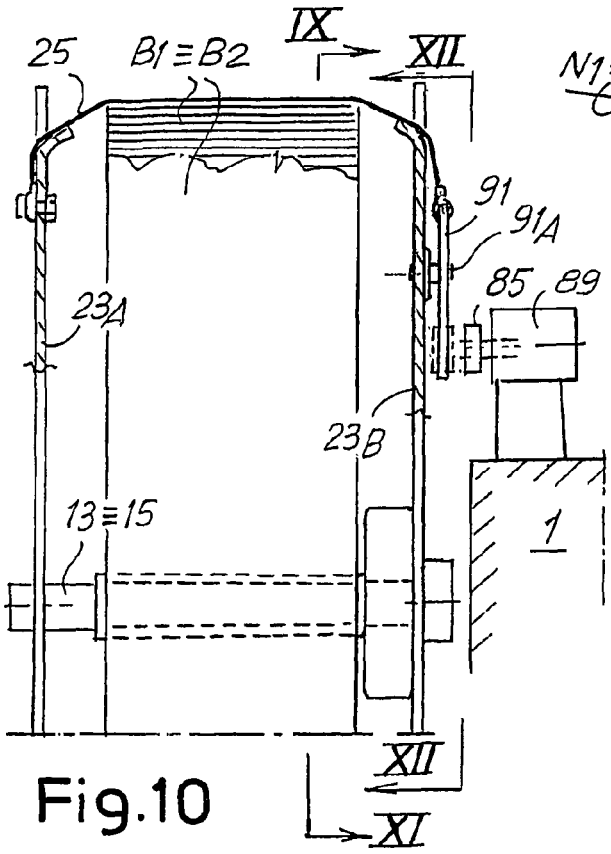
FIG. 10 shows a front view and partial section of a further embodiment of the invention.
Figure 11:
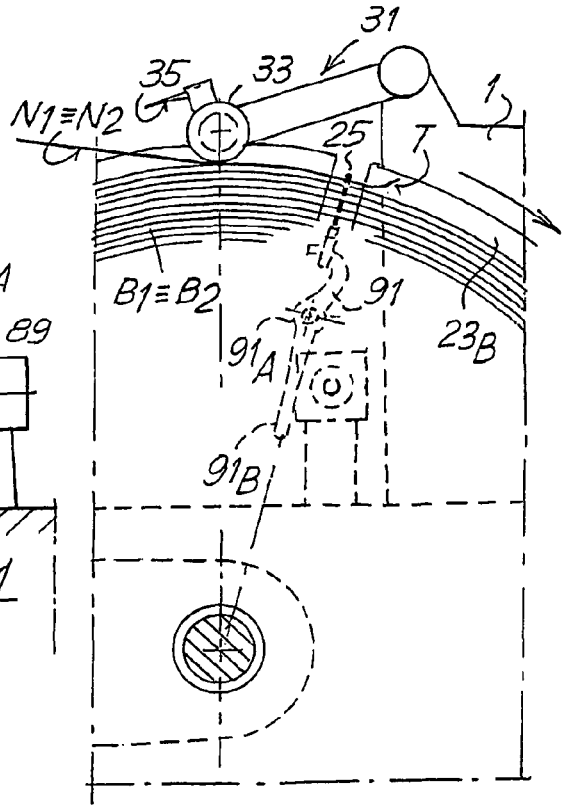
FIG. 11 shows a local section according to XI-XI in FIG. 10.
Figure 12:
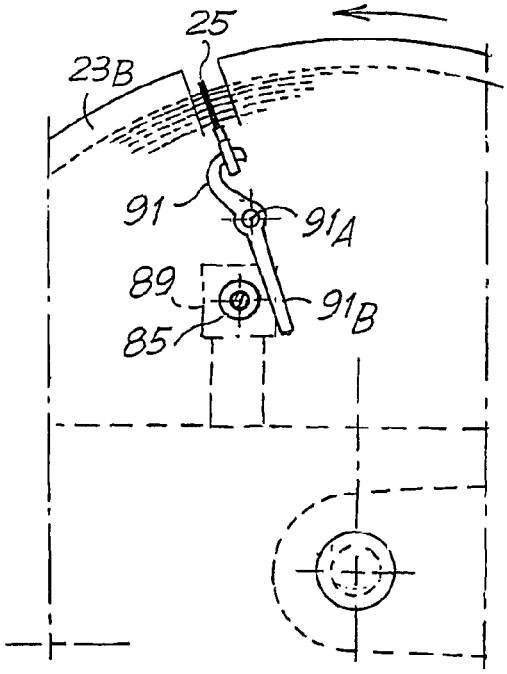
FIG. 12 shows a view according to XII-XII in FIG. 10.
Figure 13:
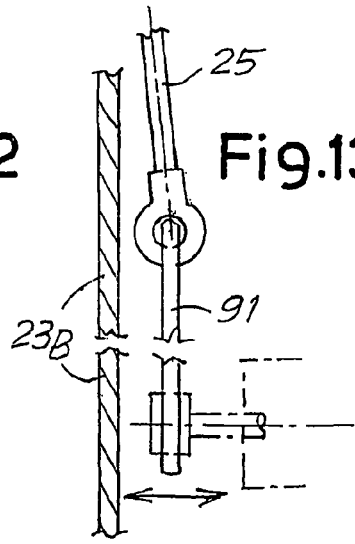
FIG. 13 shows an enlarged detail of FIG. 10.

At the moment of splicing of the web material fed from the working reel to the web material wound on the reel, the free end T of which is connected by the elastic member 25, the wheel 85 is extracted from the withdrawn position shown with the solid line in FIG. 10 to the extracted position shown in the same FIG. 10 with the dashed line and in the detail in FIG. 13. In this position it acts on the extended end 91B of the hook 91 and causes release of the end of the elastic member 25 fastened to the disk 23B. The elastic return of the member 25, which was in tension between the two disks, causes withdrawal of said member, which moves out of the area in which the web material is fed from the respective reel B1 or B2, and consequent release of the initial end T.

The above describes an unwinding system in which the reels are carried in rotation by a central system, that is, by a motorized axial support. However, it would also be possible for rotation of the reels to be obtained by means of a peripheral system, for example by means of motorized belts that act on the external surface of the reel. It would also be possible to use combined systems, which apply a driving torque by means of a central axis and by means of a peripheral flexible member.

The release systems of the retaining member can also differ from those described. For example, it would be possible to use a system comprising an actuator rotating together with the arm or with the disk supporting the retaining element and which when commanded causes release thereof. When the system comprises an elastic retaining element, as in the last example described, the hook holding the connectable end can be released by an electromagnet or other actuator. Power and actuation commands are provided by a suitable rotating distributor.

It is understood that the drawing purely shows a non-limiting practical embodiment of the invention, which may vary in forms and arrangements without however departing from the scope of protection of the invention. Any reference numerals in the appended claims are provided for the sole purpose of facilitating reading in the light of the description hereinbefore and the attached drawings and do not in any manner limit the scope of protection.

The invention claimed is:

1. An unwinding device for unwinding reels of web material comprising a rotating element with supports for at least two reels and a splicing member to join a first web material coming from an expiring reel to an initial free end of a second web material wound on a new reel; wherein at least one mechanical member is associated with each support of said supports to retain the initial free end of the new reel disposed on the support; wherein said at least one mechanical member is torsionally connected to a respective support before said splicing member joins said first web material to said initial free end of said second web material, and, is torsionally released from the respective support after said splicing member joins said first web material to said initial free end of said second web material, thereafter said at least one mechanical member being connected to said support and in a neutral position which does not interfere with unwinding of said new reel.

2. Device as claimed in claim 1, wherein said at least one mechanical member comprises at least one arm extending radially from said support and at least one retaining element carried by a free end of said at least one arm, said retaining element extending substantially parallel to an axis of the new reel disposed on said support.

3. Device as claimed in claim 2, wherein said retaining element is a roller.

4. Device as claimed in claim 3, wherein said roller is supported idle on said arm.

5. Device as claimed in claim 3, wherein said arm is adjustable in length.

6. Device as claimed in claim 2, wherein said retaining element is movable with respect to the arm.

7. Device as claimed in claim 6, wherein said retaining element cooperates with an actuator which controls withdrawal of the retaining element from the new reel disposed on said support when the second web material wound thereon is joined to the first web material of the expiring reel, withdrawal releasing the retaining element from the reel.

8. Device as claimed in claim 1, wherein said mechanical member comprises an elastic element.

9. Device as claimed in claim 8, wherein said elastic element is connectable reversibly at one end to be released when the initial free end of the second web material of the new reel is to be joined to the first web material.

10. Device as claimed in claim 8, wherein two hooking members of said elastic element are associated with each of said supports, one of said hooking members cooperating with an actuator which controls release of the elastic element.

11. Device as claimed in claim 1, wherein said splicing member comprises a roller and a cutting blade to cut the first web material coming from the expiring reel.

12. Device as claimed in claim 1, further comprising a ply-bonding unit.

13. Method for continuously feeding a web material wound on a reel to a processing machine comprising:

feeding a first web material at a feed speed from a first reel;

carrying in rotation a second reel with a second web material;

when the feed speed of the first web material is essentially same as a peripheral speed of the second reel, joining the first web material to the second web material and interrupting the first web material upstream of a splicing area between the first web material and the second web material; wherein an initial free end of the second web material is held adherent to the second reel, until splicing of the first web material and the second web material, by at least one mechanical member which rotates with said second reel; wherein each of said first reel and said second reel has one of said at least one mechanical member associated therewith; and wherein said at least one mechanical member is torsionally connected with a respective support of said second reel until said joining of the first web material to the second web material; and said at least one mechanical member is torsionally disconnected from said respective support during splicing; and carrying said at least one mechanical member to a neutral position after said splicing which does not interfere with unwinding of a new reel.

14. Method as claimed in claim 13, further comprising applying an adhesive means to an external surface of the second reel in a withdrawn position, in a direction of rotation of the second reel, with respect to a position in which said mechanical member holds the initial free end of the second web material.

15. Method as claimed in claim 14, further comprising pressing together the first web material and the second web material at a level of said adhesive means to cause said splicing of said first web material and said second web material.

16. Method as claimed in claim 13, wherein said first web material and said second web material each comprise at least one ply of tissue paper.

17. Method as claimed in claim 16, wherein each of said at least one ply of tissue paper has a weight per unit of surface ranging from 15 to 60 $g/m^2$.

18. Method as claimed in claim 13, wherein said first web material and said second web material comprise more than one ply and wherein plies of an end portion of the first web material are joined together before said splicing to the second web material.

19. Method as claimed in claim 13, wherein the mechanical member is withdrawn from an external surface of the respective reel.

20. Method as claimed in claim 13, wherein the initial free end of the second web material is held by an elastic mechanical member.

21. Method as claimed in claim 20, wherein one end of the elastic mechanical member is released during said splicing of the first web material and the second web material.

22. Method as claimed in claim 13, further comprising a pressure member acting on a surface of said second reel at least in an area between said mechanical retaining member and an area of reciprocal adhesion between the first web material and the second web material.

23. Method as claimed in claim 22, further comprising applying a strip of double-sided adhesive tape to an external surface of said second reel, in said area of reciprocal adhesion.

24. An unwinding device for unwinding reels of web material comprising:

a rotating element with supports for at least two reels, said rotating element additionally carrying at least two rollers;

a splicing member to join a first web material coming from an expiring reel to an initial free end of a second web material wound on a new reel;

at least one mechanical member associated with each support of said supports, to retain the initial free end of the new reel, wherein said at least one mechanical member is torsionally connected to a respective support before said splicing member loins said first web material to said initial free end of said second web material, and wherein said at least one mechanical member is torsionally released from the respective support after said splicing member loins said first web material to said initial free end of said second web material, thereafter said at least one mechanical member being connected to said support and in a neutral position which does not interfere with unwinding of said new reel;

a ply-bonding unit, including ply-bonding wheels for joining plies of the first web material together stably before splicing to the second web material, said ply-bonding wheels cooperating alternatively with a respective one of said rollers.

25. Device according to claim 24, wherein said rotating element includes a pair of arms supporting said rollers.

26. Device according to claim 25, wherein said rotating element includes a further pair of arms carrying said supports.

27. Device according to claim 24, wherein said ply-bonding unit is constructed and arranged to stably join together the plies of said first web material coming from said expiring reel before said splicing to the second web material coming from the new reel.

28. Device according to claim 27, wherein said ply-bonding unit is arranged to act upstream of the splicing member.

29. An unwinding device for unwinding reels of web material comprising:

a rotating element with supports for at least two reels;

a splicing member to join a first web material coming from an expiring reel to an initial free end of a second web material wound on a new reel;

at least one mechanical member associated with each of said supports, to retain the initial free end of the new reel disposed on a respective one of said supports;

wherein each mechanical member comprises an elastic element having one a first end fixed to the respective one of said supports and a second end reversibly connectable to the respective one of said supports by a hooking member associated with the respective one of the supports so that said elastic element is under tension when said second end is connected to the respective end of one of said supports, said hooking member cooperating with an actuator which controls release of the elastic element when the initial free end of the second web material is to be joined to the first web material, wherein said actuator disengages said second end of said elastic element upon said splicing member joining said first web material to said initial free end of said second web material whereupon said tension in said elastic element is released causing withdrawal of said elastic element from an area in which web material is fed and consequent release of the initial free end.

30. Device according to claim 29, wherein each said elastic element includes two hooking members associated with each of said supports.

31. Device according to claim 30, wherein a first end of each elastic element is fixed to a first disc or arm integral with the respective one of said supports and a second end of said elastic element is reversibly connectable to a second disc or arm integral with said respective one of said supports.

32. Device according to claim 29, wherein a first end of each elastic element is fixed to a first disc or arm integral with the respective one of said supports and a second end of said elastic element is reversibly connectable to a second disc or arm integral with said respective one of said supports.

* * * * *

UNITED STATES PATENT AND TRADEMARK OFFICE

CERTIFICATE OF CORRECTION

PATENT NO. : 7,726,598 B2
APPLICATION NO. : 10/586590
DATED : June 1, 2010
INVENTOR(S) : Alessandro Morelli and Mauro Gelli It is certified that error appears in the above-identified patent and that said Letters Patent is hereby corrected as shown below:

Title Page,
Item (54) "UNWIDING DEVICE FOR REELS OF WEB MATERIAL AND RELATIVE METHOD"
should read
-- UNWINDING DEVICE FOR REELS OF WEB MATERIAL AND RELATIVE METHOD --.

Column 1,
Lines 1 and 2, "UNWIDING DEVICE FOR REELS OF WEB MATERIAL AND RELATIVE METHOD"
should read
-- UNWINDING DEVICE FOR REELS OF WEB MATERIAL AND RELATIVE METHOD --.

Column 8,
Lines 54 and 58, "loins" should read -- joins --.

Signed and Sealed this
Twenty-fifth Day of January, 2011

David J. Kappos

David J. Kappos
*Director of the United States Patent and Trademark Office*